US008079497B2

(12) United States Patent
Brouwer

(10) Patent No.: US 8,079,497 B2
(45) Date of Patent: Dec. 20, 2011

(54) DISPENSER WITH IMPROVED SUPPLY-CLOSING MEANS

(75) Inventor: Markus Franciskus Brouwer, Heesch (NL)

(73) Assignee: MeadWestvaco Calmar Netherlands B.V., Richmond, VA (US)

( * ) Notice: Subject to any disclaimer, the term of this patent is extended or adjusted under 35 U.S.C. 154(b) by 820 days.

(21) Appl. No.: 11/911,951

(22) PCT Filed: Apr. 19, 2006

(86) PCT No.: PCT/NL2006/000204
§ 371 (c)(1),
(2), (4) Date: Jun. 19, 2008

(87) PCT Pub. No.: WO2006/112701
PCT Pub. Date: Oct. 26, 2006

(65) Prior Publication Data

US 2009/0039110 A1 Feb. 12, 2009

(30) Foreign Application Priority Data

Apr. 20, 2005 (NL) ..... 1028827

(51) Int. Cl.
*B67D 5/58* (2006.01)

(52) U.S. Cl. ..... 222/153.13; 222/190; 222/321.9; 222/135

(58) Field of Classification Search ..... 222/190, 222/383.1, 383.3, 153.13, 384, 135, 137, 222/321.7–321.9
See application file for complete search history.

(56) References Cited

U.S. PATENT DOCUMENTS

| | | | | |
|---|---|---|---|---|
| 5,443,569 | A * | 8/1995 | Uehira et al. | 222/190 |
| 5,570,819 | A * | 11/1996 | Uehira et al. | 222/190 |
| 5,813,576 | A * | 9/1998 | Iizuka et al. | 222/190 |
| 6,065,647 | A * | 5/2000 | Bliss et al. | 222/153.02 |
| 6,193,112 | B1 * | 2/2001 | Santagiuliana | 222/153.13 |
| 6,398,079 | B1 | 6/2002 | Garcia et al. | |
| 6,840,408 | B1 | 1/2005 | Foster et al. | |

FOREIGN PATENT DOCUMENTS

| | | |
|---|---|---|
| EP | 0618147 A2 | 10/1994 |
| JP | 07300150 | 11/1995 |
| WO | 2004/069418 A1 | 8/2004 |
| WO | W02006/112704 | 10/2006 |

OTHER PUBLICATIONS

International Search Report and Written Opinion for International Application No. PCT/NL2006/000204 (WO 2006/112701) mailed Jul. 28, 2006 (6 pages).

* cited by examiner

*Primary Examiner* — Kevin P Shaver
*Assistant Examiner* — Donnell Long
(74) *Attorney, Agent, or Firm* — MWV Intellectual Property Group

(57) ABSTRACT

The invention relates to a dispensing unit, particularly suitable for a liquid container, comprising an air pump with an air cylinder and an air piston (31), wherein an air chamber (32) is defined between the air cylinder and the air piston, a liquid pump with a liquid cylinder and a liquid piston (24), wherein a liquid chamber (30) is defined between the liquid cylinder and the liquid piston. An axially displaceable activating element (36) for activating the pumps, and upper edge (50) of air piston (31) for closing air supply to the air pump, and an oblique wall (51) of activating element (36) for closing air discharge from the air pump. The air piston and the liquid piston are movable in axial direction relative to the activating element in order to close air supply to the air pump and close air discharge from the air pump.

26 Claims, 8 Drawing Sheets

DISPENSER WITH IMPROVED SUPPLY-CLOSING MEANS

The invention relates to a dispensing unit, particularly suitable for a liquid container, comprising an air pump with an air cylinder and an air piston, wherein an air chamber is defined between the air cylinder and the air piston, a liquid pump with a liquid cylinder and a liquid piston, wherein a liquid chamber is defined between the liquid cylinder and the liquid piston, an axially displaceable activating element for activating the pumps, supply-closing means for closing air supply to the air pump, and discharge-closing means for closing air discharge from the air pump.

Such a dispensing unit is for instance known from WO 2004/069418. The dispensing unit shown herein is fastened onto a liquid container by means of a threaded ring in order to obtain a foam pump. The activating element is connected to a cover with spout for dispensing foam. The activating element is movable relative to the liquid container. With the foam pump in the hand product can be dispensed by pressing the cover.

The present invention has for its object to provide a foam pump for use on a surface, for instance a draining board of a kitchen, wherein dispensing takes place with the palm of the hand. For this purpose the movable cover must take a larger form. In addition, the spout must be embodied with a length such that the other hand can receive the dispensed product. Due to the use of the long spout an outer cover, and thereby protection during transport, is not possible. A per se known locking system must be arranged in order to prevent product or foam being dispensed during transport. Locking is released by rotating the spout. In existing pumps the locking mechanism is arranged between the threaded ring and the cover by means of a rib on the cover which drops into a recess of the threaded ring. This has the result that liquid (water or foam) can run into the pump. The consequence hereof can be that this liquid is drawn in, whereby the pump can become blocked or germ formation can result in the pump because liquid becomes lodged in "dead" corners. In order to be able to realize an improved locking system wherein the above stated drawbacks are obviated, the valve system of the above mentioned, known dispensing unit must be revised.

The object of the present invention is to provide an improved dispensing unit.

For this purpose the dispensing unit is characterized according to the invention in that the air piston and the liquid piston are movable in axial direction relative to the activating element in order to form the supply and discharge-closing means for air.

In contrast to the existing dispensing unit, the closing means for air are actively switched. Actively is understood to mean mechanically. The supply-closing means are closed and the discharge-closing means are opened by moving the activating element.

In a preferred embodiment the activating element and the axially movable air piston together form the supply-closing means for air, while the activating element and the axially movable liquid piston together form the discharge-closing means for air. No additional closing means are necessary. Use is advantageously made of the components of the dispensing unit already present to form the desired seal. An exceptionally simple dispensing unit is hereby obtained at favourable cost.

The activating element is further arranged in at least axial direction between the air piston and liquid piston, so that the supply-closing means are closed and the discharge-closing means are opened by one and the same movement of the activating element. Dispensing of the product can be started with a small stroke.

In addition, the activating element preferably co-acts with the air piston for compressing the air in the air chamber. In a first part of the forward stroke the air supply to the air pump will be closed, whereafter the air is compressed in the pump in the second part.

In one embodiment an insert is fixedly connected to the activating element. The activating element preferably co-acts with the liquid piston via the insert in order to make the liquid chamber smaller. Together with the liquid piston, the insert forms a mixing chamber for mixing air from the air pump and liquid from the liquid pump.

The dispensing unit is preferably further provided with a base part which is fixedly or integrally connected to the air cylinder and/or the liquid cylinder, wherein spring means are arranged between the base part and the air piston. The spring means serve for resetting of the air piston in the return stroke.

The same spring means which co-act with axial ribs with a first length on the periphery of the activating element are utilized for the purpose of resetting the activating element in the return stroke. The activating element preferably comprises on its periphery axial ribs of a second length which co-act with the air piston. In the forward stroke it is in fact the seal between the upper edge of the air piston and the activating element (supply-closing means) which defines the stopping point. These ribs of a second length are arranged on the activating element in order to prevent damage to the relatively thin upper edge of the air piston. The first length is preferably greater than the second length. The distance between the short and long ribs on the periphery of the activating element determines the stroke the air piston can make relative to the activating element for switching the supply-closing means. The full stroke is achieved when the ribs of short length engage on protrusions on the inner side of the air piston. These protrusions are advantageously also used for engaging the spring.

The dispensing unit is preferably further provided with a locking mechanism for locking the activating element in axial direction.

In an advantageous embodiment the locking mechanism is arranged between the activating element and the base part. The locking mechanism is situated in the interior of the pump, thereby avoiding entry of water or foam into the pump as described above with reference to the prior art.

The base part preferably comprises a central sleeve which is provided on the outer periphery with at least one axial rib and wherein the activating element is provided on the inner side close to its bottom end with at least one radial groove and an axial groove connecting thereto for co-action with the rib on the base part. By rotating the activating element relative to the base part the rib is brought into line with the axial groove, and the activating element can perform an up and downward stroke necessary for dispensing product. It is of course also possible to provide the rib on the base part and the grooves on the activating element.

The dispensing unit is preferably further provided with a screw element with which the assembly of activating element, liquid and air pump can be screwed onto an opening of a liquid container.

In addition, the activating element is preferably connected fixedly or integrally to a cover which is provided with a dispensing channel which is connected to the liquid and air pump. The dispensing channel is preferably situated in a spout formed in the cover.

In order to prevent water or foam from entering the dispensing unit, the screw element and the cover together form an at least splash-proof seal.

In addition, the invention relates to a dispensing assembly consisting of a liquid container and a dispensing unit as specified herein.

The invention will be further elucidated with reference to the accompanying drawings. In the drawings.

Figure 1:
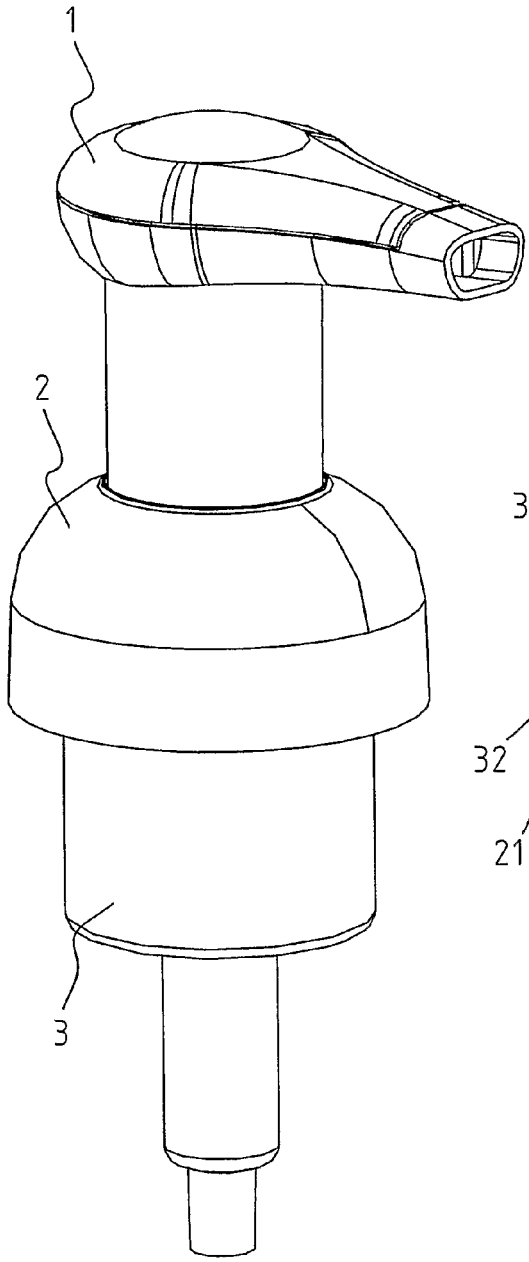
FIG. 1 shows a perspective view of an exemplary embodiment of a dispensing unit according to the invention.
Figure 9:
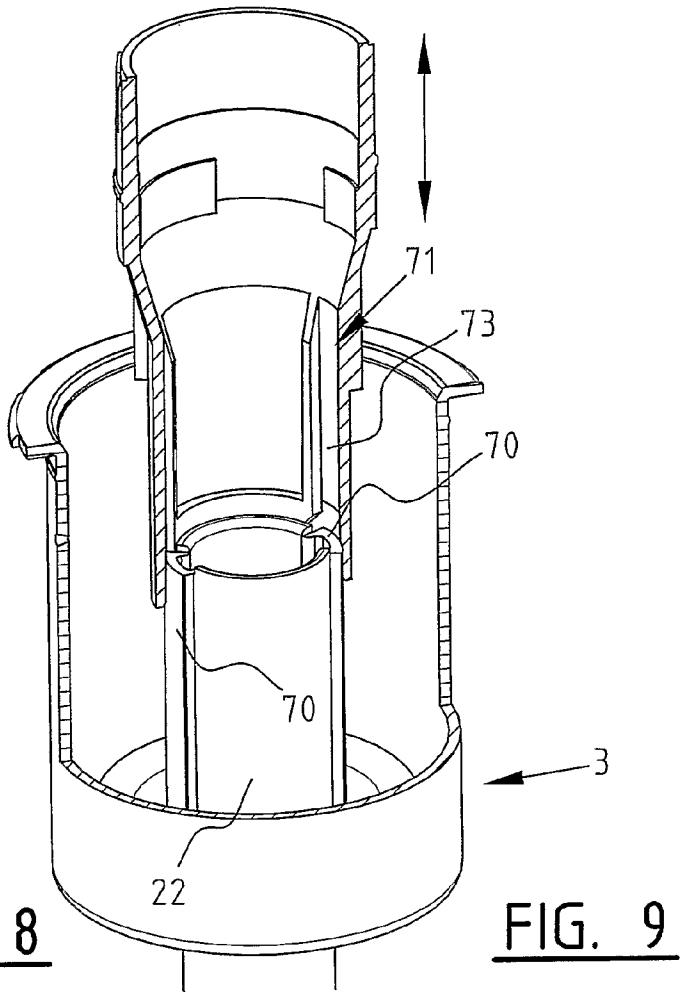
Figure 8:
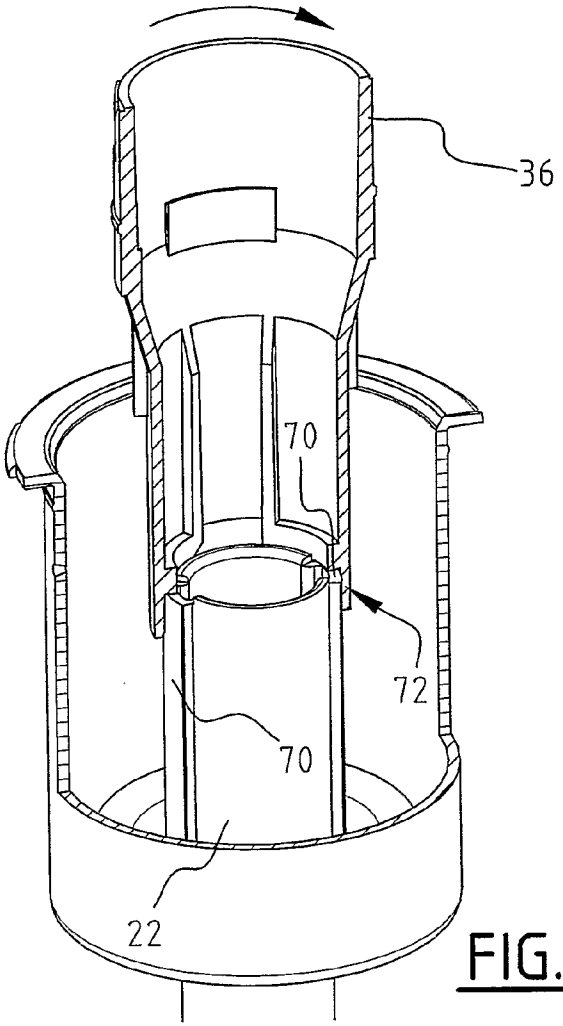
Figure 7:
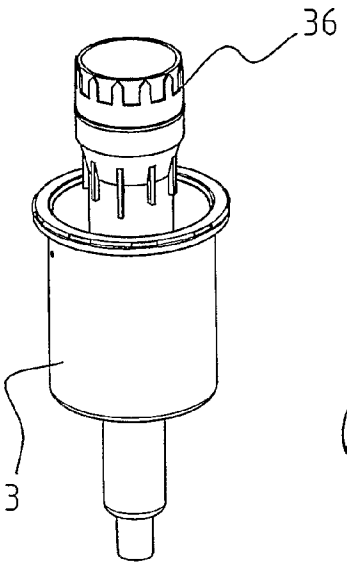

FIGS. 6A-D are cross-sections of the dispensing unit shown in FIG. 1 in different positions;

FIG. 7 shows a locking of the dispensing unit shown in FIG. 1;

FIG. 8 shows the locking of FIG. 7 in partial cross-section in a first position; and FIG. 9 shows the locking of FIG. 7 in partial cross-section in a second position.

FIG. 1 shows an exemplary embodiment of a dispensing unit which is particularly suitable for arranging on a liquid container. The dispensing unit comprises an operating element 1, a threaded ring 2 and a base part 3. The dispensing unit can be screwed fixedly onto a neck of a liquid container by means of threaded ring 2. Base part 3 herein extends into the liquid container. A liquid hose can be coupled to the bottom end of base part 3 for drawing liquid out of the container. Operating element 1 can be moved up and downward relative to threaded ring 2 and base part 3 for the purpose of dispensing product formed from liquid in the container and air drawn in from the environment. The air and the liquid are mixed together and dispensed by the dispensing unit as mist or, as in the present example, as foam.

Figure 2:
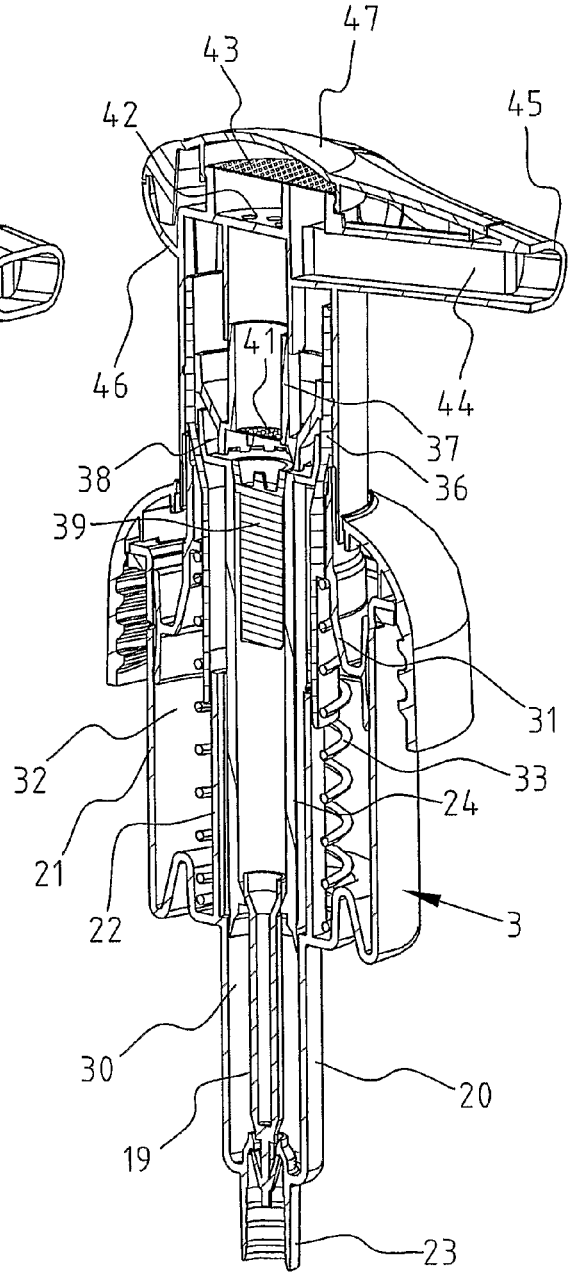
FIG. 2 shows the dispensing unit of FIG. 1 in cross-sectional view.

FIG. 2 show the dispensing unit of FIG. 1 in cross-section. Different components hereby become visible. Reference numeral 3 once again designates the base part. The base part comprises an outer casing of small diameter 20, an outer casing of large diameter 21, and an inner casing 22. The outer casing of small diameter 20 is provided with an inlet opening 23 to which a liquid hose can be coupled. A mandrel-like element 19 is received for axial displacement in the outer casing of small diameter 20 (see FIG. 4).

The inner casing of smaller diameter 20 forms a liquid cylinder of a liquid pump. A liquid piston 24 is arranged for axial sliding in the liquid cylinder. A liquid chamber 30 is situated between liquid piston 24 and liquid cylinder 20.

The outer casing of large diameter 21 forms the air cylinder in which an air piston 31 is received for axial sliding. An air chamber 32 is situated between air piston 31 and air cylinder 21. A spring 33 is arranged in air chamber 32 between air piston 31 and base part 3.

An activating element 36 is arranged between air piston 31 and liquid piston 24. Activating element 36 consists of a lower part with a relatively small diameter, an upper part with a relatively large diameter and an intermediate bridging part. The bridging part has an oblique wall 51 (see also FIG. 5) which can come into contact with air piston 31 and liquid piston 24 in order to form closing means, as will be further elucidated hereinbelow. Activating element 36 is further positioned with its lower end over inner casing 22. Close to its upper end the activating element 36 is connected fixedly to operating element 1. An insert 37 is placed in the upper part of the activating element. Insert 37 is connected fixedly to activating element 36 in axial direction. Air piston 24 is provided at its upper end with a wall 38 which is directed first laterally, then obliquely upward and finally upward (see FIG. 3).

A liquid valve 39 is arranged in liquid piston 24. The weight of this liquid valve 39 normally ensures closing of liquid pump 20,24. The underpressure created in liquid chamber 30 during suctioning also ensures that liquid valve 39 is pressed into its seat. When pressure is built up in liquid chamber 30, liquid valve 39 will be opened and the liquid will be able to flow upward out of liquid chamber 30.

Located above liquid valve 39 is a mixing chamber 40 (see FIG. 3) which is formed on the one hand by wall 38 of liquid piston 24 and on the other by insert 37. The upper wall of mixing chamber 40 is formed by a screen 41 formed integrally with insert 37. A second screen 42 is arranged in the head of operating element 1. Right at the top of the head, directly below the upper wall of operating element 1, is situated a third screen 43, through which the product for dispensing passes twice. After the product has passed through screen 43 for the second time, it will leave dispensing unit 1 via an outflow channel 44 and an outflow opening 45. Opening element 1 is in fact formed by two components 46, 47 which are clicked into each other during assembly.

Figure 3:
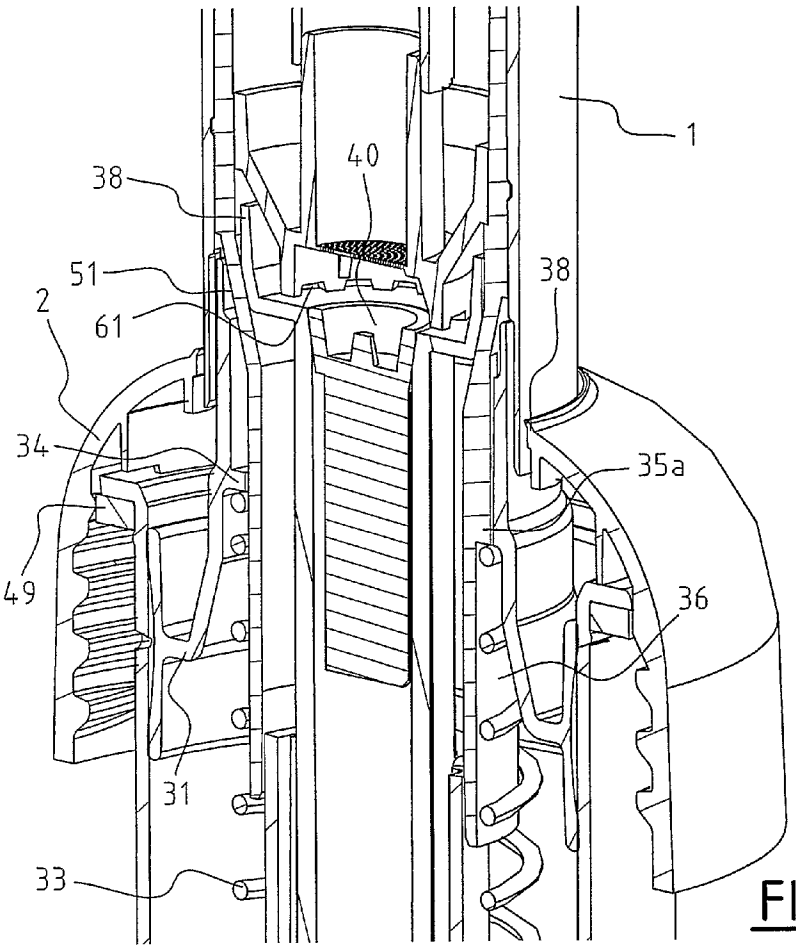
FIG. 3 shows a detail of FIG. 2.

FIG. 3 shows a part of the dispensing unit of FIG. 2 in more detail. It can be readily seen here that spring 33 engages on an inner peripheral edge 34 of air piston 31, and on ribs 35*a* provided on the outer periphery of activating element 36 (see also FIG. 5).

It can further be seen here that operating element 1 extends downward, wherein its bottom edge lies under an opening in threaded ring 2. Between the edge of the opening in threaded ring 2 and the outer casing of operating element 1 is arranged a standing edge 48 which provides for a splash-proof connection between operating element 1 and threaded ring 2.

Threaded ring 2 is freely rotatable relative to operating element 1 and base part 3. The dispensing unit can hereby be aligned with a liquid container when it is screwed onto the container. The container is often oval-shaped and the spout of the operating element is preferably positioned on the container such that it is lies transversely of the widest walls of the container during use. Arranged under the flanged edge of the base part is a sealing ring 49 which ensures that no liquid can leak out of the container via the screw thread.

According to the invention and as can be seen in FIG. 3, operating element 1 is clicked fixedly onto activating element 36. Air piston 31 and liquid piston 24 are not connected to activating element 36. They are therefore freely movable in axial direction. Together with the axially freely movable air piston 31 and the axially freely movable liquid piston 24, activating element 36 forms respectively the inlet valve and outlet valve for air. The inlet valve for air is formed between upper edge 50 of air piston 31 (see also FIG. 5) and (the outer side of) the oblique wall part 51 of activating element 36. The outlet valve is formed by (the inner side of) the oblique wall part 51 of activating element 36 and the oblique wall part 38 of liquid piston 24.

Figure 4:
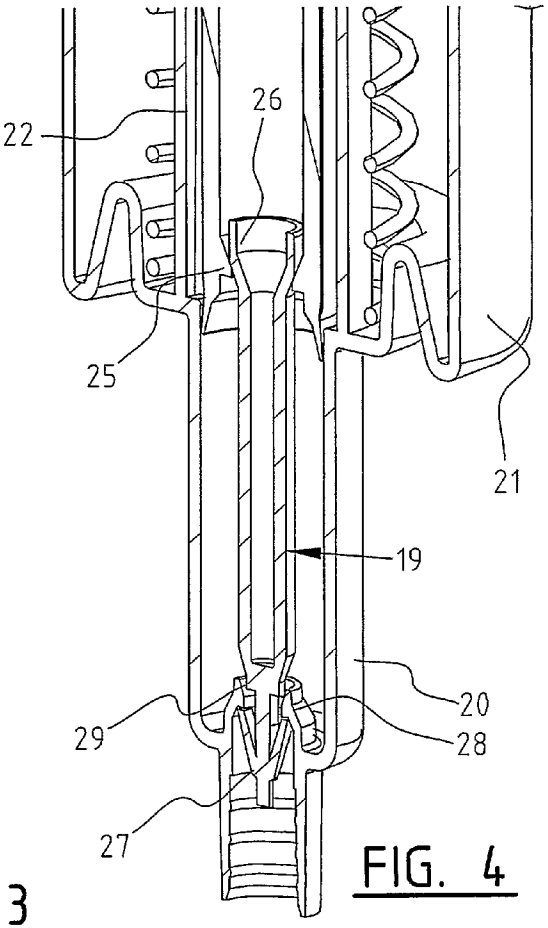
FIG. 4 shows another detail of FIG. 2.

FIG. 4 clearly shows that liquid piston 24 is provided on its bottom end with an inner peripheral edge 25 for the purpose of forming a seat for a liquid valve 26 co-acting therewith. Liquid valve 26 is formed integrally with the mandrel-like element 19. This element 19 is provided on its lower end with barbs 27 for locking behind an inward directed protruding edge 28 of base part 3. The hooked outer end 27 hooks behind the underside of protruding edge 28 and thereby holds together the components of the dispensing unit. The upper side of protruding edge 28 forms a seat for a liquid valve 29 which is situated close to the bottom end of mandrel-like element 19, just above the barbed outer end 27.

Liquid valve 29 forms the suction valve of the liquid pump to be further described hereinbelow, while liquid valve 26 forms a liquid transport lock. During transport and in situations wherein the container is under pressure, this liquid valve 26 ensures that the liquid cannot flow out of the dispensing unit.

Figure 5:
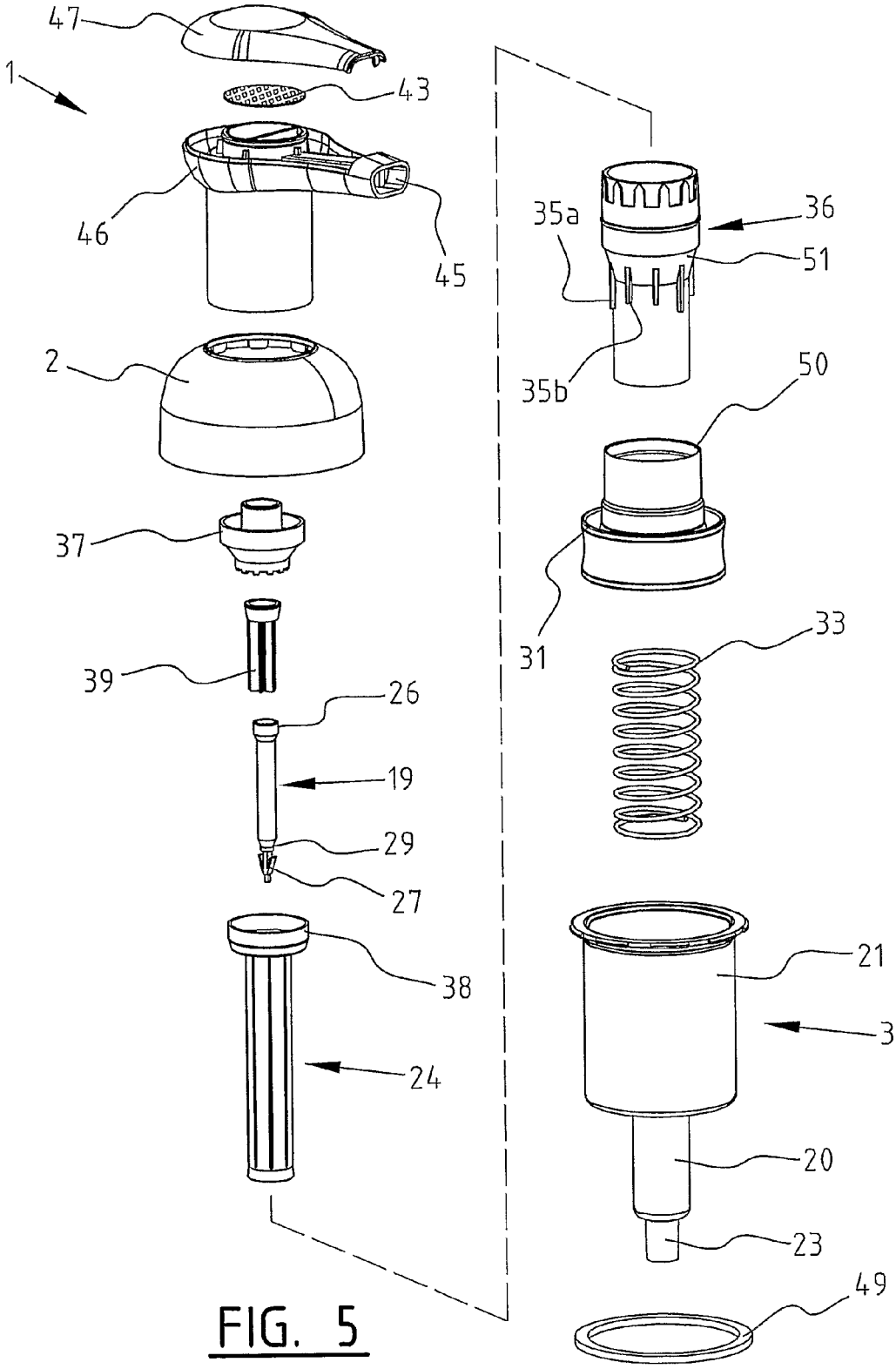
FIG. 5 shows the dispensing unit of FIG. 1 with exploded parts.

FIG. 5 shows the dispensing unit of FIG. 1 with exploded parts. Corresponding components are designated with the same reference numerals. FIG. 5 shows how the dispensing unit is assembled and mounted. The hook-like outer end 27 of mandrel-like element 19 is carried beyond the inward directed protruding edge 28 of base part 3. This mandrel-like element 19 holds all components of the unit in place. It can further be seen in FIG. 5 that activating element 36 is provided on its outer periphery with ribs 35*a*, 35*b* of differing lengths.

Figure 6A:
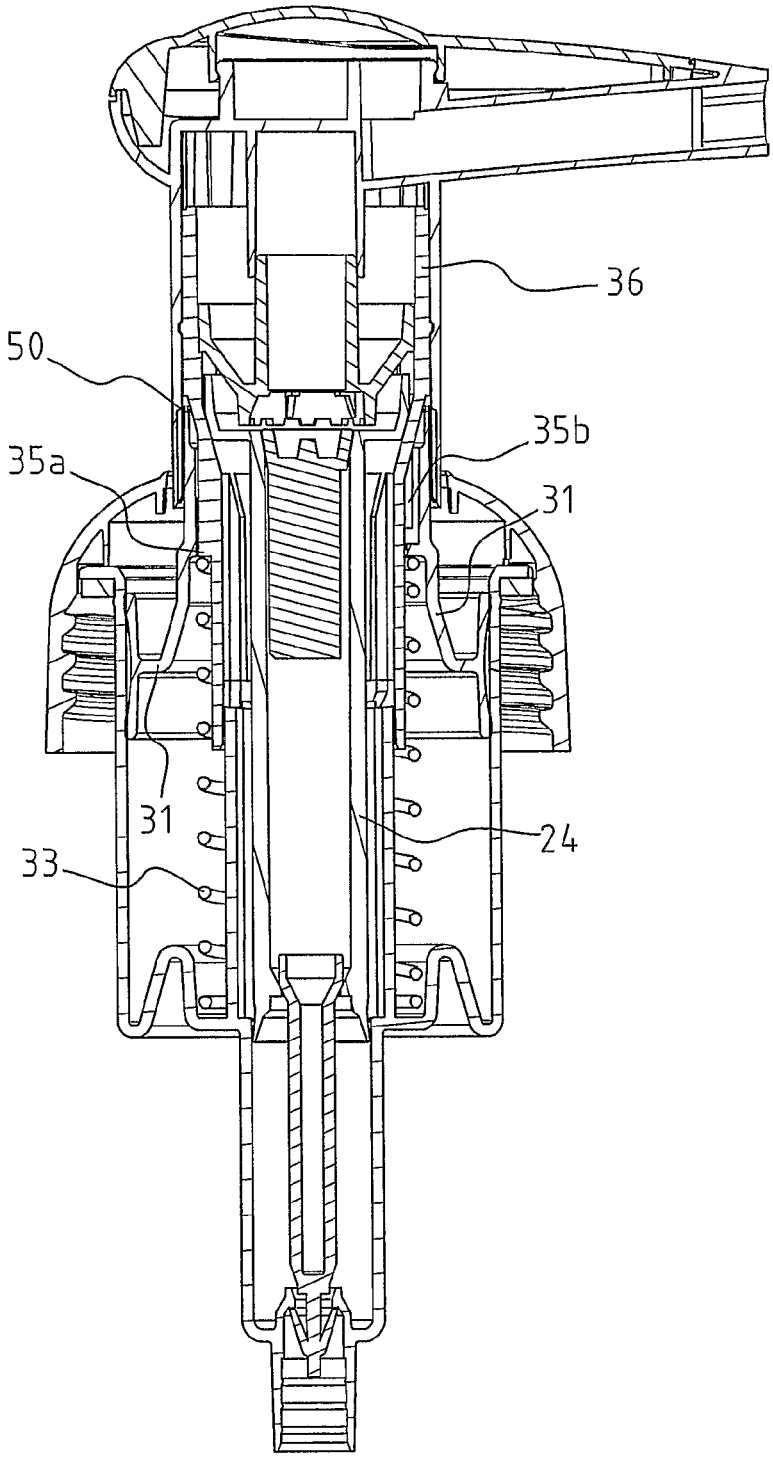

FIG. 6A shows a first position, a starting position, of the dispensing unit according to the invention. In this position the spring 33 presses activating element 36 into its uppermost position via ribs 35*a*. In addition, spring 33 presses air piston 31 into its uppermost position. Air piston 31, and particularly upper edge 50 thereof, is situated a short distance from activating element 36. When activating element 36 is pressed downward over this short distance (see also FIG. 6B), the inlet valve formed between air piston 31 and activating element 36 will simultaneously be closed, and the outlet valve formed between activating element 36 and liquid piston 24 will be opened. The distance between the long and short ribs 35*a*, 35*b* on the outer periphery of activating element 36 partially defines the stroke which air piston 31 can make relative to activating element 36. In the forward situation it is actually the seal of upper edge 50 of air piston 31 with the oblique wall 51 of activating element 36 which determines the stopping point. The short ribs 35*b* are arranged on activating element 36 in order to prevent damage to the relatively thin upper edge 50 of air piston 31.

Figure 6B:
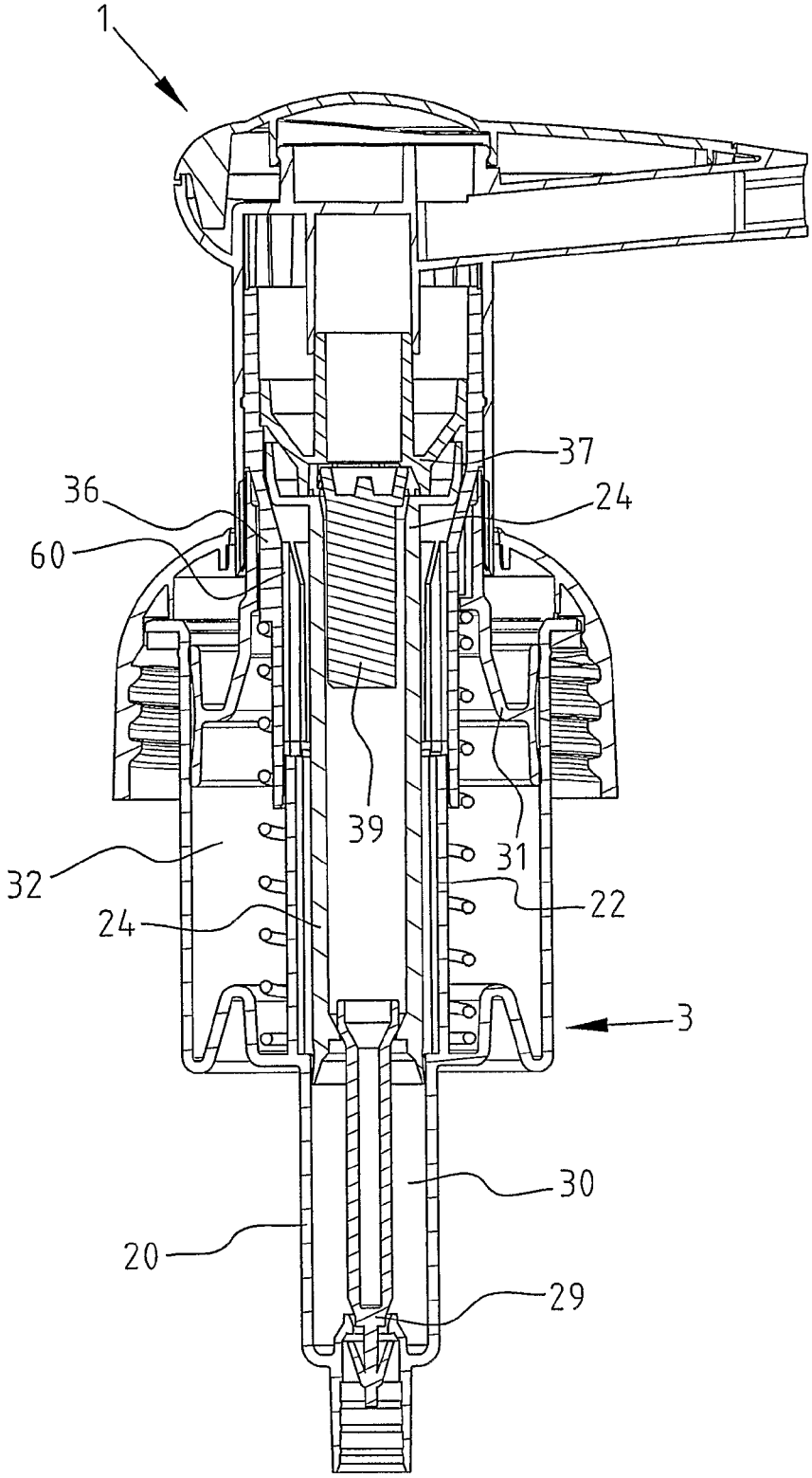
Figure 6C:
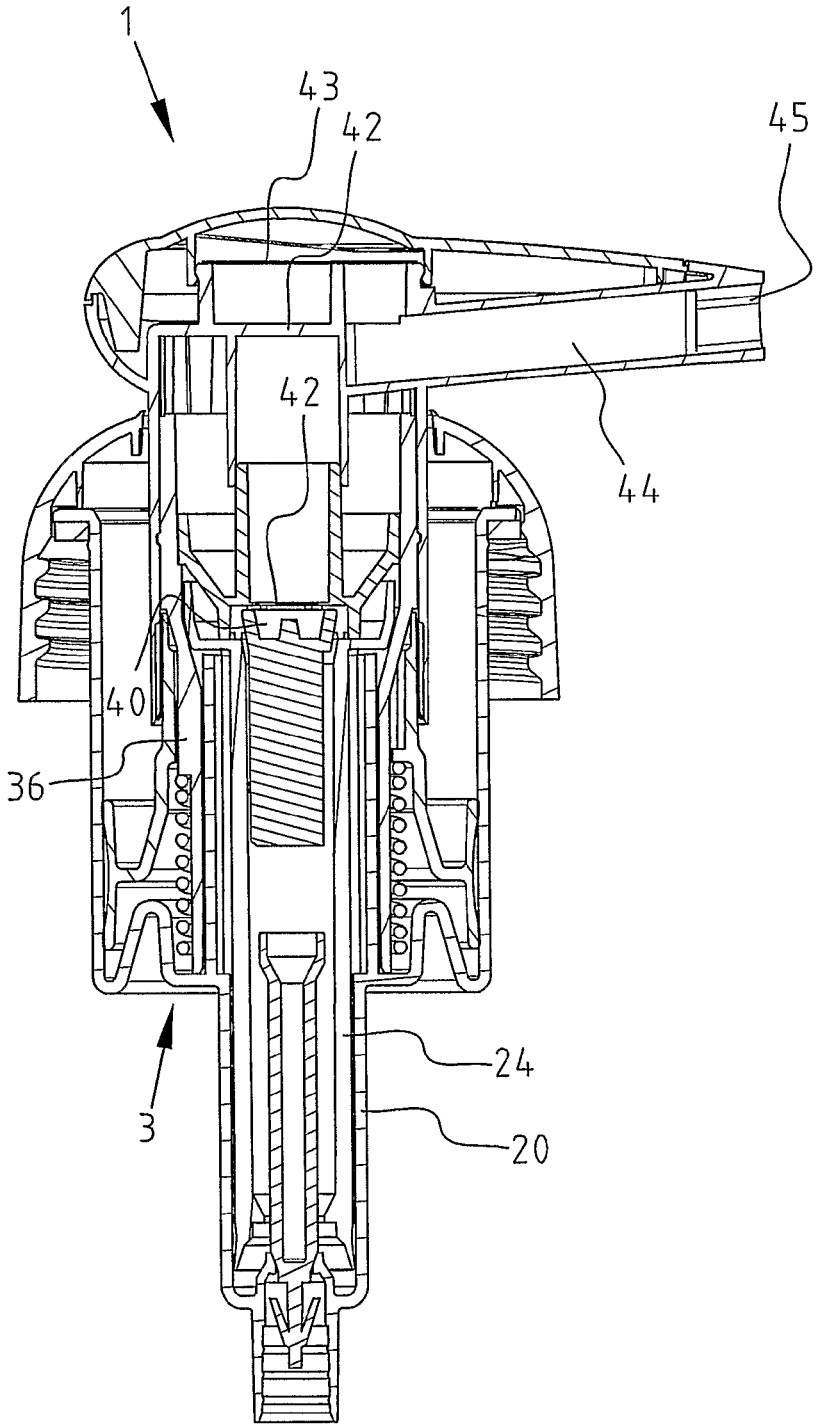
Figure 6D:
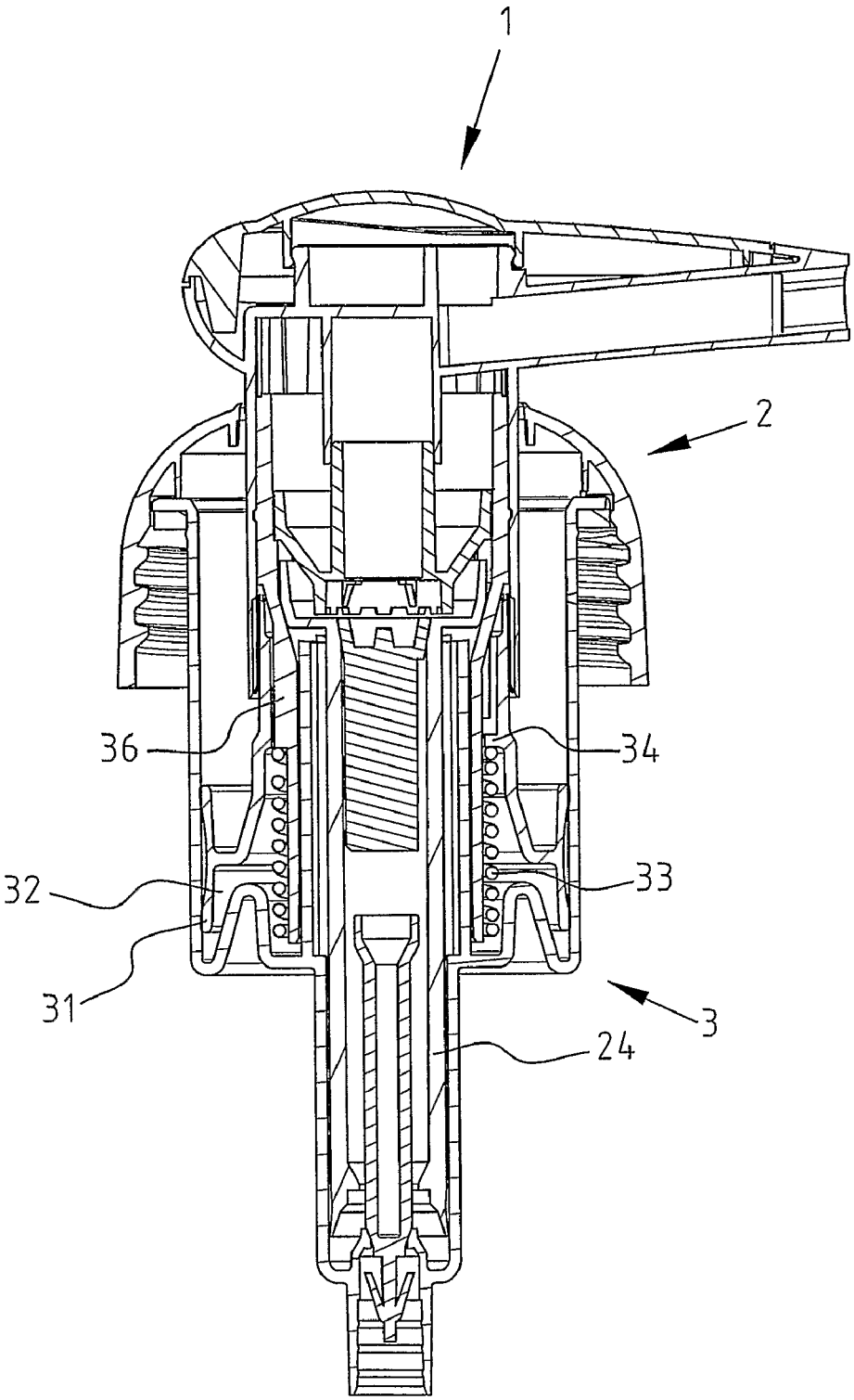

As stated, the air inlet valve is closed and the air outlet valve opened during an initial, short stroke from the position shown in FIG. 6A to the position shown in FIG. 6B. This situation is then shown in FIG. 6B. Together with activating element 36, air piston 31 will perform a further stroke from the position shown in FIG. 6B when operating element 1 is pressed in further. The volume of air chamber 32 is herein reduced and the air in air chamber 32 will be compressed. The air will be able to flow out of air chamber 32 in the direction of the outlet valve via channels 60 located between activating element 36 and inner casing 22 of base part 3. The outlet valve is in an opened position so that the air can flow further to the mixing chamber. Channels 61 (see FIG. 3) are formed for this purpose between insert 37 and liquid piston 24. FIG. 6C shows the other extreme position in which the forward stroke has reached its end position when activating element 36 stops against base part 3. Liquid chamber 30 will likewise be made smaller in the large forward stroke from the position shown in FIG. 6B to the position shown in FIG. 6C. Reducing the size of liquid chamber 30 has the result that liquid valve 29 will close. The pressure build-up in liquid chamber 30 provides for upward displacement of the freely movable liquid valve 39 so that discharge of liquid from liquid pump 20, 24 is possible. The liquid herein flows into mixing chamber 40 via the space between liquid valve 39 and liquid piston 24. In the mixing chamber the liquid is mixed with the air. The mixture of liquid and air passes through screens 41, 42 and 43 and then leaves outflow opening 45 in the spout of operating element 1 via outflow channel 44. Dispensing of product therefore takes place during the movement of operating element 1 from the position shown in FIG. 6B to the position shown in FIG. 6C.

In the return stroke, when operating element 1 is released, spring 33 will first displace activating element 36 upward over a short distance. The inlet valve between air piston 31 and activating element 36 is hereby opened and the outlet valve between activating element 36 and liquid piston 24 is simultaneously closed. Air can hereby be drawn in via the screw thread between threaded ring 2 and the liquid container and the inlet valve in air chamber 32 of the air pump. In addition, the spring comes into contact with inner peripheral edge 34 of air piston 31. Spring 33 therefore then provides for resetting of both activating element 36 and air piston 31 to the starting position shown in FIG. 6A. During this latter large stroke air is drawn into air chamber 32.

During the return stroke piston 31 in the first instance remains stationary due to friction with the wall of air cylinder 21 and, after reaching the end its short free stroke, is carried along by the spring. This is also the case in the reverse situation for liquid piston 24. In the first instance this remains in position during the downward stroke due to the resistance with the wall of liquid cylinder 20. After reaching its short stroke it is pressed downward by insert 37.

FIGS. 7-9 show the locking mechanism according to the invention. The locking mechanism serves to lock the activating element in axial direction. It is hereby not possible to activate the pumps and therefore dispense product. The locking must be released by the user prior to use. According to the invention the locking mechanism is arranged between activating element 36 and base part 3. FIG. 7 shows how these two components are placed in each other in the final dispensing unit. FIGS. 8 and 9 show in partially cross-sectional perspective view two different positions of the assembly consisting of activating element 36 and base part 3. Inner casing 22 of base part 3 is provided with two axial ribs 70. These axial ribs 70 extend over at least a large part of the length of inner casing 22. Activating element 36 is provided on its inner periphery close to its lower end with a groove 71, which groove comprises a radial part 72 and an axial part 73 connecting thereto. Such a groove is provided on the inner periphery of activating element 36 for each rib 70. In the locked position each rib 70 of the base part lies in the radial groove part 72 of groove 71. In groove 71 a stop is further present in the radial groove part. Further rotation is hereby prevented in the blocked situation and the user has a sensitive feedback.

By rotating activating element 36 from the position shown in FIG. 8, the rib 70 can be brought into line with axial groove part 71 so that axial displacement of activating element 36 relative to base part 3 is possible.

The shown locking mechanism provides only a locking of activating element 36 in its uppermost position (see FIG. 6A). A locking can also be obtained in the lower position by a small modification of grooves 71 on the activating element and ribs 70 on the base part. In addition, it is also possible to provide the ribs on the activating element and the grooves on the base part. The invention is therefore not limited to the exemplary embodiment shown in the figures, but only by the appended claims.

The invention claimed is:

1. A dispensing unit for a liquid container, comprising:

an air pump with an air cylinder and an air piston, wherein an air chamber is defined between the air cylinder and the air piston;

a liquid pump with a liquid cylinder and a liquid piston, wherein a liquid chamber is defined between the liquid cylinder and the liquid piston;

an axially displaceable activating element for activating the air pump and the liquid pump;

a mixing chamber for mixing air from the air pump and liquid from the liquid pump;

a supply-closing element for closing air supply to the air pump; and a discharge-closing element for closing air discharge from the air pump to the mixing chamber, wherein the air piston and the liquid piston are movable in an axial direction relative to the activating element thereby forming the supply-closing element and the discharge-closing element for air;

and a base part connected to one of the air cylinder and the liquid cylinder, wherein a locking mechanism for locking the activating element in an axial direction is arranged between the activating element and the base part.

2. The dispensing unit as claimed in claim 1, wherein the activating element and the axially movable air piston form the supply-closing element for air.

3. The dispensing unit as claimed in claim 1, wherein the activating element and the axially movable liquid piston form the discharge-closing element for air.

4. The dispensing unit as claimed in claim 1, wherein the activating element is arranged in at least an axial direction between the air piston and the liquid piston.

5. The dispensing unit as claimed in claim 1, wherein the activating element co-acts with the air piston for compressing the air in the air chamber.

6. The dispensing unit as claimed in claim 1, wherein an insert is fixedly connected to the activating element.

7. The dispensing unit as claimed in claim 6, wherein the activating element co-acts with the liquid piston via the insert in order to make the liquid chamber smaller.

8. The dispensing unit as claimed in claim 6, wherein the insert and the liquid piston form a mixing chamber for mixing air from the air pump and liquid from the liquid pump.

9. The dispensing unit as claimed in claim 1, further comprising a base part which is fixedly or integrally connected to the air cylinder and/or the liquid cylinder, wherein a spring means are arranged between the base part and the air piston.

10. The dispensing unit as claimed in claim 9, wherein the activating element comprises on its periphery axial ribs of a first length which co-act with the spring means.

11. The dispensing unit as claimed in claim 10, wherein the activating element comprises on its periphery axial ribs of a second length which co-act with the air piston.

12. The dispensing unit as claimed in claim 11, wherein the first length is greater than the second length.

13. The dispensing unit as claimed in claim 12, wherein the axial ribs of a second length engage on protrusions on the inner side of the air piston.

14. The dispensing unit as claimed in claim 13, wherein the spring means engages on the protrusions on the inner side of the air piston.

15. The dispensing unit as claimed in claim 1, further comprising a screw element, wherein the dispensing unit can be screwed onto an opening of a liquid container by the screw element.

16. The dispensing unit as claimed in claim 15, wherein the activating element is connected fixedly or integrally to a cover, wherein the cover is provided with a dispensing channel connected to the liquid pump and the air pump.

17. The dispensing unit as claimed in claim 16, wherein the screw element and the cover together form an at least splash-proof seal.

18. The dispensing unit as claimed in claim 15, wherein the screw element is freely rotatable relative to the dispensing unit.

19. A dispensing assembly comprising a liquid container and a dispensing unit as claimed in claim 1.

20. A method of dispensing a mixture of a liquid and air, said method comprising:

mixing a liquid with air using a dispensing unit for a liquid container to form a mixture of the liquid and air;

dispensing the mixture from the dispensing unit, wherein the dispensing unit comprises:

an air pump with an air cylinder and an air piston, wherein an air chamber is defined between the air cylinder and the air piston;

a liquid pump with a liquid cylinder and a liquid piston, wherein a liquid chamber is defined between the liquid cylinder and the liquid piston;

an axially displaceable activating element for activating the air pump and the liquid pump;

a mixing chamber for mixing air from the air pump and liquid from the liquid pump;

a supply-closing element for closing air supply to the air pump;

a discharge-closing element for closing air discharge from the air pump to the mixing chamber, wherein the air piston and the liquid piston are movable in an axial direction relative to the activating element thereby forming the supply-closing element and the discharge-closing element for air; and and a base part connected to one of the air cylinder and the liquid cylinder, wherein a locking mechanism for locking the activating element in an axial direction is arranged between the activating element and the base part.

21. The method as claimed in claim 20, wherein the mixture is a mist.

22. The method as claimed in claim 20, wherein the mixture is a foam.

23. The method as claimed in claim 20, wherein the activating element and the axially movable air piston form the supply-closing element for air.

24. The method as claimed in claim 20, wherein the activating element and the axially movable liquid piston form the discharge-closing element for air.

25. The method as claimed in claim 20, wherein the dispensing unit further comprises a locking mechanism for locking the activating element in an axial direction.

26. A dispensing unit for a liquid container, comprising:

an air pump with an air cylinder and an air piston, wherein an air chamber is defined between the air cylinder and the air piston;

a liquid pump with a liquid cylinder and a liquid piston, wherein a liquid chamber is defined between the liquid cylinder and the liquid piston;

an axially displaceable activating element for activating the air pump and the liquid pump;

a mixing chamber for mixing air from the air pump and liquid from the liquid pump;

a supply-closing element for closing air supply to the air pump;

a discharge-closing element for closing air discharge from the air pump to the mixing chamber, wherein the air piston and the liquid piston are movable in an axial direction relative to the activating element thereby forming the supply-closing element and the discharge-closing element for air; and a base part which is fixedly or integrally connected to the air cylinder and/or the liquid cylinder, wherein a spring means are arranged between the base part and the air piston, wherein the activating element comprises on its periphery axial ribs of a first length which co-act with the spring means.

* * * * *